United States Patent [19]

Andersson

[11] Patent Number: 4,475,947

[45] Date of Patent: Oct. 9, 1984

[54] METHOD FOR RECOVERING HEAT FROM DUST-BEARING GASES PRODUCED IN SMELTING SULPHIDE CONCENTRATES AND MEANS HEREFOR

[75] Inventor: Bengt T. Andersson, Espoo, Finland

[73] Assignee: Outokumpu Oy, Helsinki, Finland

[21] Appl. No.: 541,347

[22] Filed: Oct. 12, 1983

[51] Int. Cl.[3] ..... C22B 5/02

[52] U.S. Cl. ..... 75/92; 75/60

[58] Field of Search ..... 74/92, 60, 25

[56] References Cited

U.S. PATENT DOCUMENTS

| | | | |
|---|---|---|---|
| 4,218,241 | 8/1980 | Hegemann | 75/60 |
| 4,308,057 | 12/1981 | Ono | 75/60 |
| 4,407,672 | 10/1983 | Deuschle | 75/25 |
| 4,415,142 | 11/1983 | Hegemann | 75/60 |

*Primary Examiner*—Peter D. Rosenberg

*Attorney, Agent, or Firm*—Brooks, Haidt, Haffner & Delahunty

[57] ABSTRACT

The present invention relates to a method and a means for recovering heat from dust-bearing gases produced in the suspension smelting of sulphide concentrates. In order to reduce the tendency of the dusts to create accretions in the waste heat boiler (5), to the dust-bearing gases produced in the suspension smelting process (1) and/or to the slag is admixed a cooler, partly reactive fluid (12) prior to bringing them into indirect heat exchange contact in the waste heat boiler (5).

In the combination of suspension smelting furnace (1) and waste heat boiler (5) connected thereafter, as taught by the invention, the vertical radiation section (6) of the waste heat boiler (6) has been connected at its lower end, either directly or by means of a short water-cooled connecting part (9), to the settler (3) of the suspension smelting furnace and at the top end by a likewise vertical screen section (10) to a substantially horizontal convection section (7), in which connection adjacent to the juncture of the settler (3) and the radiation section (6) or its connecting part (9) are provided members (12) for supplying a cooler substance into the dust-bearing gases flowing from the settler (3) to the radiation section and/or into the slag in the settler.

7 Claims, 3 Drawing Figures

Figure 1:
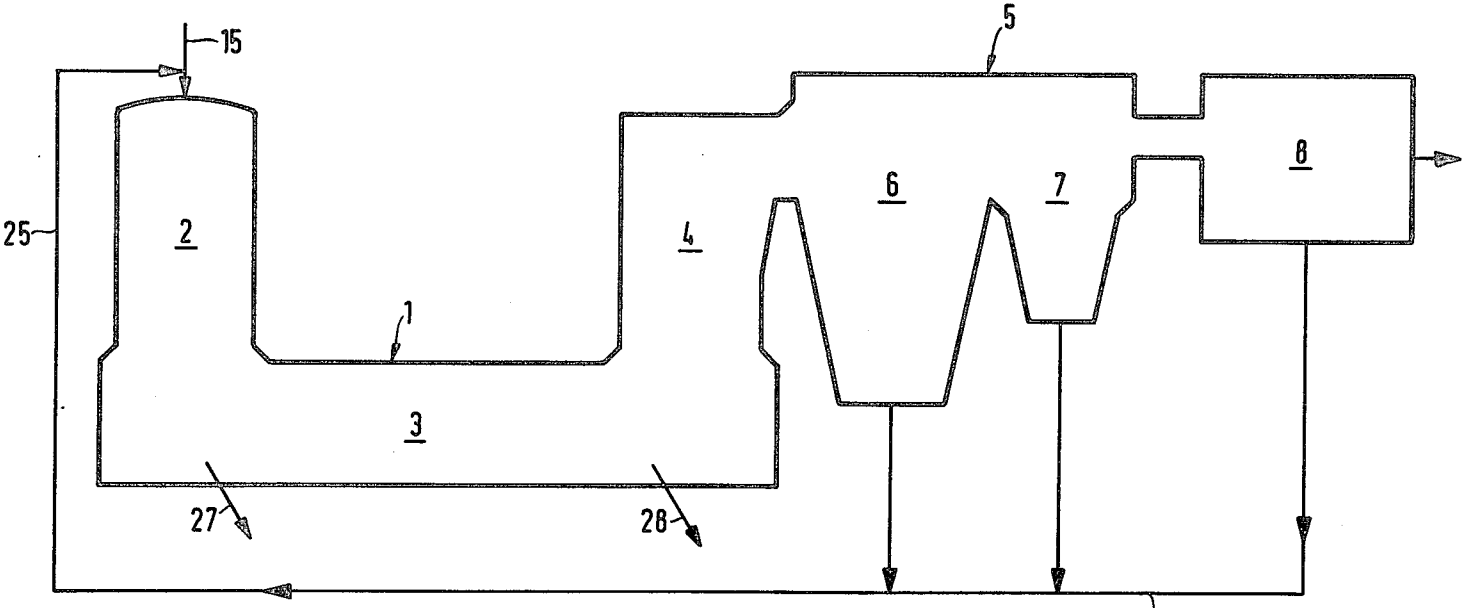

METHOD FOR RECOVERING HEAT FROM DUST-BEARING GASES PRODUCED IN SMELTING SULPHIDE CONCENTRATES AND MEANS HEREFOR

The present invention relates to a method for recovering heat from dust-bearing gases produced in the suspension smelting process of sulphide concentrates by bringing the gases in indirect heat exchange contact, separating the dust components from the cooled gases and returning at least part of the separated dusts to the suspension smelting process. Moreover, the invention relates to a combination of suspension furnace and a waste heat boiler connected thereafter, this combination comprising means for returning the separated dust to the suspension smelting furnace.

In a suspension smelting process, for instance in the flash smelting process developed by the company Outokumpu Oy, dust-bearing hot gases are generated the temperature of which usually is 1300°–1500° C. The heat contained in these gases has been recovered by means of a two-part waste heat boiler comprising a radiation section and a convection section.

Since the gases entering the waste heat boiler are hot and contain free oxygen and sublimating and sintering substances, part of the dust that separates from the gases is in adherent form. When cooling, said dust tends to adhere to the uptake shaft of the flash smelting furnace and to the heat surfaces of the waste heat boiler and to produce accretions impeding the passage of the gases. The removal of said accretions from the uptake shaft of the flash smelting furnace has as a rule been carried out by blasting with dynamite or with the aid of separate oil burners, and from the waste heat boiler by the aid of automatic soot blowers or hammer means with which the dust accretions have been knocked off. In addition, the walls of the dust-collecting funnels in the lower part of the radiation section and the convection section of the waste heat boiler have been made smooth and steep in shape, so that the dust that has settled on them might run down without once again producing accretions or occlusions. If accretions are produced, the cooling capacity of the heat surfaces is rapidly impaired. The dust recovered both from the waste heat boiler and from the electric filter has been returned to the feed of the flash smelting furnace.

It should moreover be noted that the dust-bearing gases of the suspension smelting furnace being treated contain, depending on the degree of oxygen enrichment, a relatively large amount of sulphur dioxide, typically 10–50%, and therefore the treatment basins have to be hermetically sealed. The operating pressure of the waste heat boiler is furthermore required to be sufficiently high so that the surface temperature of the pipe systems carrying the steam being generated from the heat could be maintained above the sulphuric acid dew-point of said gas. Endeavours to remove dust accretions have, however, increased the water leakages from the boiler pipes.

Thus, the object of the present invention is to provide a method and a means for recovering heat from dust-bearing hot gases generated in suspension smelting without allowing the dusts to generate accretions difficult to detach which would impede the passage of the gases, in the waste heat boiler of the flash smelting furnace or in the electric filter.

The main characteristics of the invention are presented in claim 1 stated below.

Generation of accretions difficult to detach in the waste heat boiler is prevented in a preferred embodiment of the invention by admixing to the dust-bearing hot gases produced in the suspension smelting process and/or to the slag produced from the smelting furnace, part of the feed intended for suspension smelting, the sulphide concentrate and the slagging agent before bringing the gases into indirect heat exchange contact. The mixing is carried out to advantage substantially close to the point of departure of the dust-bearing gases from the suspension smelting.

The method of the invention is carried out advantageously with a combination of suspension smelting furnace and a waste heat boiler connected thereafter, in said combination the vertical radiation section of the waste heat boiler being connected by its lower part either directly or over a short pre-cooled connecting part to the settler of the suspension smelting furnace and at its upper part by a likewise vertical screen section eith a substantially horizontal convection section, in the vicinity of the juncture of the settler and the radiation section or its connecting part being provided feed members for feeding a cooler substance, such as the feed of the suspension smelting furnace, potential extra fuel and part of the dust separated from the gases, into the dust-bearing gases flowing into the radiation section from the settler and/or into the slag being formed in the settler.

The radiation section of the boiler is advantageously so configurated that the dust separated therein runs directly back into the settler or through a funnel onto conveyor belt. The lower part of the radiation section or the connecting part may be provided with a damper for isolating the waste heat boiler from the settler for servicing the waste heat boiler, there being provided an openable exit port before the damper, for conducting the dust-bearing gases elsewhere.

Figure 2:
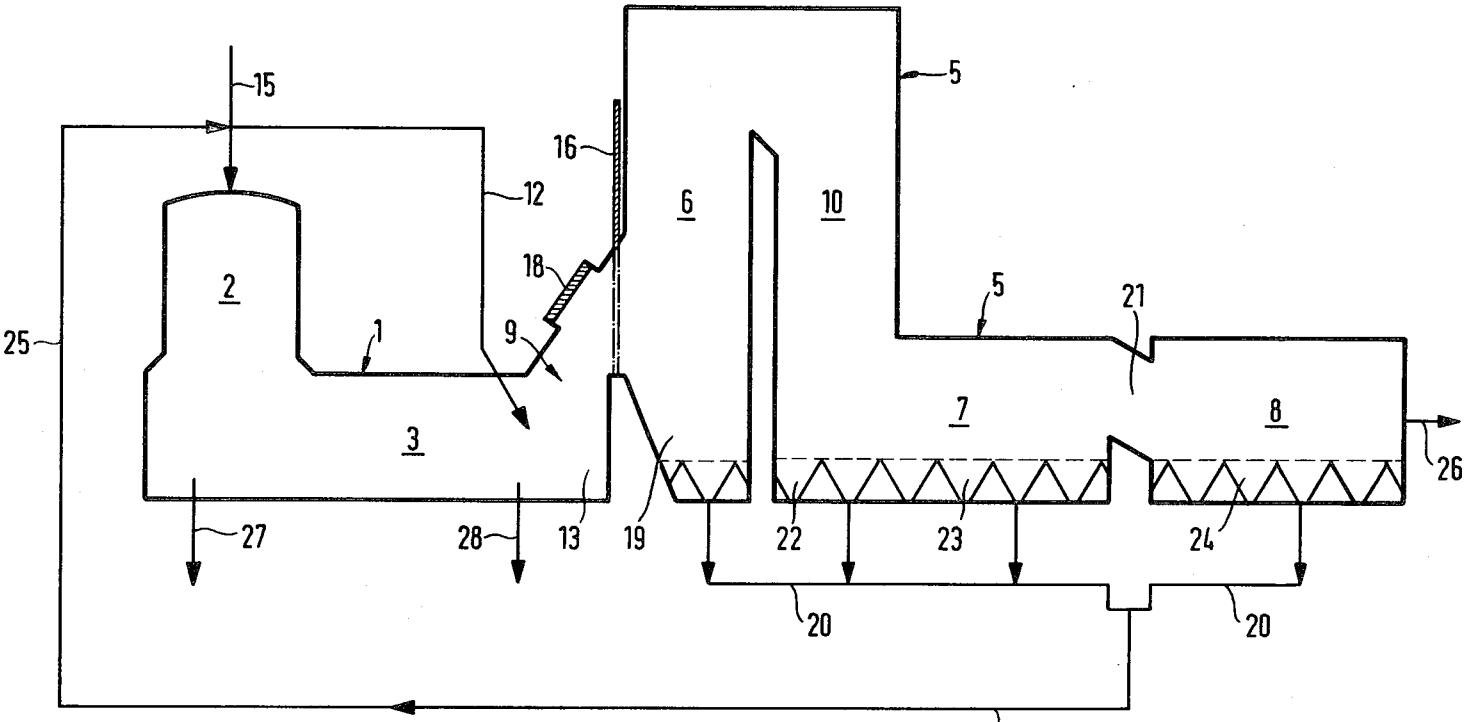
Figure 3:
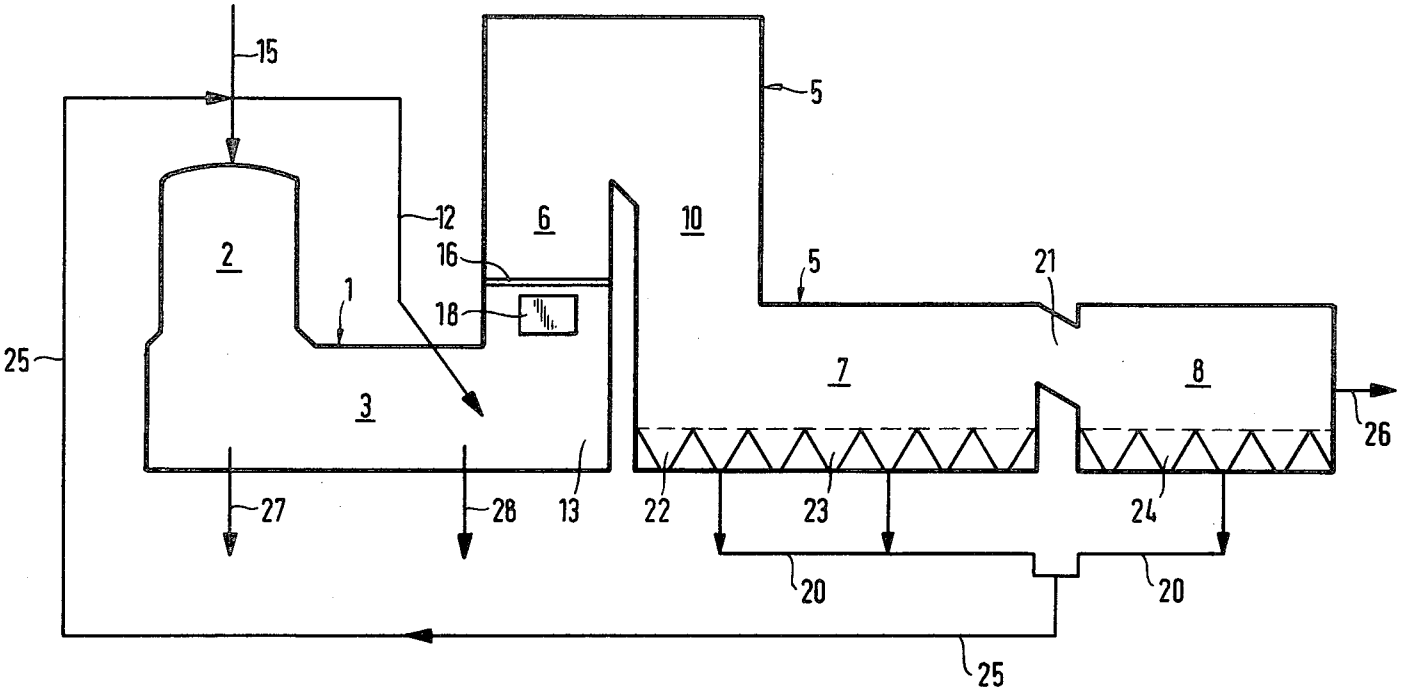

The invention is described in detail by referring to the drawings attached, wherein:

FIG. 1 presents a schematical sectional elevational view of a conventional combination of flash smelting furnace and waste heat boiler, FIG. 2 presents a likewise schematical sectional elevational view of the suspension smelting furnace/waste heat boiler combination of the invention, FIG. 3 presents a schematical sectional elevational view of an alternative embodiment of the invention, in which the vertical radiation section of the waste heat boiler has been connected by its lower end directly to above the settler of the suspension smelting furnace.

Thus, FIG. 1 presents a conventional combination of a flash smelting furnace 1 and a waste heat boiler 5. The flash smelting furnace 1 consists of a horizonal settler 3 and of a vertical reaction shaft 2 and an uptake shaft 4 joined to its opposite ends, the upper part of said uptake shaft 4 being connected to the convection section 7 of the waste heat boiler 5, whence the gases are ultimately conducted to the electric filter 8. The dusts separated in the radiation section 6 and in the convection section 7 and electric filter 8 are returned by the conveyor 25 back to the feed in the reaction shaft 2 of the flash smelting furnace 1.

The uptake shaft of the flash smelting furnace (4 in FIG. 1) has in the embodiment of the invention depicted in FIG. 2 been replaced by a short connecting part 9 between the waste heat boiler 5 and the flash smelting furnace 1. The waste heat boiler 5 consists of a vertical radiation section 6 and a screen section 10, and of a horizontal convection section 7. In the embodiment of FIG. 3, the radiation section 6 and connecting part 9 depicted in FIG. 2 have been altered so that the radiation section 6 is located directly above the settler 3 in the place of the conventional uptake shaft.

As taught by the invention, when for instance high-grade copper matte or blister copper 27 is produced, part of the feed of the flash smelting furnace 1 is supplied to the rear end 13 of the settler 3, as shown in FIG. 2 or 3. Conducting part 12 of the feed 15 of the flash smelting furnace 1 directly to the rear end 13 of the settler 3, the precious metal contents and quantities in the slag 28 that is produced can be reduced from those in the conventional feeding method, while at the same time the characteristics of the dust-bearing gases departing from the flash smelting furnace 1 are changed. Moreover, owing to the rear end feed 13, the temperature of the gases when entering the radiation section 6 of the waste heat boiler 5 is lowered, and hereby the accretion-producing tendency of the dust is reduced. When a reactive fluid 12 is fed to the rear end 13, the accretion-producing tendency of the dust becomes less and more efficient utilisation of total oxygen and total energy is achieved as the settler feed 12 reacts with the oxygen present in the smelting products. In addition, the sulphuric acid dewpoint of the dust-bearing gases flowing from the settler to the radiation section is lowered.

Between the flash smelting furnace 1 and the radiation section 6 of the waste heat boiler 5 has also been constructed a damper 16, whereby during potential boiler repairs the dust-bearing gases are removed through the exit port 18.

As taught by the invention, the dust-bearing gases are carried from the settler 3 of the flash smelting furnace 1 through the connecting part 9 to the vertical radiation section 6 of the waste heat boiler, wherein, if required, cooling panels parallelling the gas flow may be installed. In the radiation section 6, the dust that has departed from the gases is conducted through the funnel 19 onto the conveyor belt 20 to be recirculated into the flash smelting furnace 1 (FIG. 2) or back directly to the rear end 13 of the settler 3 (FIG. 3). From the radiation section 6 the dust-bearing gases are directed by the aid of cooling panels, parallelling the gas flow, in the screen section 10 to the horizontal convection section 7 of the waste heat boiler 5 and further through a short connecting duct 21 to the electric filter 8. The dusts that have departed from the gases in the screen section 10 of the waste heat boiler 5, in the convection section 7 and in the electric filter 8 are through funnels 22, 23 and 24 carried onto the conveyor belt 20, while the gases 26 are conducted to further treatment.

By the means and method of the invention, more favourable total process and apparatus designs are achieved than in prior art, at the same time as the operation of the equipment is made easier and their reliability in operation increases. Regarding efficiency of temperatures, the flash smelting furnace waste heat boiler of the invention is considerably superior to the so-called "horizontal" boiler (FIG. 1) presently in common use, since it has been understood to eliminate the greater part of the inactive funnel volume and area, thanks to more favourable flow conditions. Simultaneously, the dust recovery apparatus is also reduced in size and in price, compared with the prior art.

I claim:

1. A method for recovering heat from dust-bearing gases produced in suspension smelting of sulphide concentrates, by bringing the gases into indirect heat exchange contact in a waste heat boiler, by separating the dusts from the cooled gases and by returning at least part of the separated dusts to the suspension smelting comprising admixing to the dust bearing gases produced in the suspension smelting process or into the slag a cooler, reacting fluid substantially prior to bringing the gases into indirect heat exchange contact in the waste heat boiler.

2. A method according to claim 1, characterized in that to the dust-bearing gases produced in the suspension smelting process or to the slag is admixed part of the feed intended for the suspension smelting prior to bringing the gases into indirect heat exchange contact.

3. A method according to claim 1 or 2, characterized in that to dust-containing gases produced in the suspension smelting process or to the slag is admixed at least part of the slagging agent or extra fuel needed in the suspension smelting process prior to bringing them into indirect heat exchange contact.

4. A method according to claim 1 or 2 characterized in that the mixing is carried out in substantial vicinity of the exit point of the dust-bearing gases from the suspension smelting process.

5. A combination of a suspension smelting furnace and a waste heat boiler connected thereafter, comprising members for returning the dust that has been separated therein to the suspension smelting furnace, characterized in that a vertical radiation section of the waste heat boiler is connected at its lower end either directly or by means of a short water-cooled connection part to a settler of the suspension smelting furnace, and at its top end likewise by a vertical screen section to a substantially horizontal convection section, and that in the vicinity of the juncture of the settler and the radiation section, or its connecting part there are members for supplying a cooler, reactive substance from the settler into the dust-bearing gases flowing into the radiation section and/or into the slag in the settler.

6. A combination according to claim 5, characterized in that in the lower part of the radiation section there are members for returning the dust separated in the radiation section into the upper part of the reaction shaft of the suspension smelting furnace and/or into the vicinity of the juncture between the settler and the radiation section or its connecting part.

7. A combination according to claim 5 or 6, characterized in that in the lower part of the radiation section or in the connecting part has been provided a damper and an openable exit port for conducting elsewhere the dust-bearing gases flowing from the settler when the damper is closed.

* * * * *

UNITED STATES PATENT AND TRADEMARK OFFICE

CERTIFICATE OF CORRECTION

PATENT NO. : 4,475,947

DATED : October 9, 1984

INVENTOR(S) : Bengt T. Andersson

It is certified that error appears in the above-identified patent and that said Letters Patent is hereby corrected as shown below:

On the title page:

Priority information has been omitted:

--[30] Foreign Application Priority Data

Oct. 13, 1982[FI] Finland.....823482--.

Signed and Sealed this

*Twenty-third* Day of *April 1985*

[SEAL]

*Attest:*

DONALD J. QUIGG

*Attesting Officer* *Acting Commissioner of Patents and Trademarks*